US005284618A

United States Patent [19]

Allouard et al.

[11] Patent Number: 5,284,618

[45] Date of Patent: Feb. 8, 1994

[54] NIOBIUM AND TITANIUM BASED ALLOYS RESISTANT TO OXIDATION AT HIGH TEMPERATURES

[75] Inventors: Michel L. Allouard, Paris; Yves C. Bienvenu, Evry; Christophe Delaunay, Paris; Christian A. B. Ducrocq, Taverny; Gérard Lemaitre, Colombes; Michel Marty, Buc; André Walder, l'Hay les Roses, all of France

[73] Assignees: Association pour la Recherche et le Developpement des Methodes et Processus Industriels "A.R.M.I.N.E.S."; Societe Nationale d'Etude et de Construction de Moteurs d'Aviation "S.N.E.C.M.A.", both of Paris, France

[21] Appl. No.: 854,895

[22] Filed: Mar. 20, 1992

[30] Foreign Application Priority Data

Mar. 20, 1991 [FR] France ..... 91 03373

[51] Int. Cl.[5] ..... C22C 14/00

[52] U.S. Cl. ..... 420/426; 420/417; 420/418; 420/421

[58] Field of Search ..... 420/426, 417, 418, 421

[56] References Cited

U.S. PATENT DOCUMENTS

| | | | |
|---|---|---|---|
| 2,822,268 | 2/1958 | Hix | 75/174 |
| 5,006,307 | 4/1991 | Jackson | 420/426 |
| 5,019,334 | 5/1991 | Jackson | 420/426 |
| 5,032,357 | 7/1991 | Rowe | 420/418 |

FOREIGN PATENT DOCUMENTS 0345599 12/1989 European Pat. Off. ..... C22C 27/04

OTHER PUBLICATIONS

Kaltenbach et al., Z. Metallkde, 80 (Aug. 1989) 535.

Cho et al. Met. Trans. 21A (Mar. 1990) 641.

*Primary Examiner*—Upendra Roy

*Attorney, Agent, or Firm*—Oblon, Spivak, McClelland, Maier & Neustadt

[57] ABSTRACT

A niobium and titanium based alloy having a density less than 6.5 and possessing a high resistance to oxidation at high temperatures in the region of 900° C. has a chemical composition comprising, in atomic percentages:

more than 24% Nb
from 30 to 48% Ti
from 21 to 38% Al and possibly up to 8% of at least one of Cr, Mo, V and Zr.

5 Claims, 4 Drawing Sheets

NIOBIUM AND TITANIUM BASED ALLOYS RESISTANT TO OXIDATION AT HIGH TEMPERATURES

FIELD OF THE INVENTION

The present invention relates to a group of low-density, niobium and titanium based alloys which combine good mechanical strength resulting from the precipitation of one or more high-temperature stable phases with a high resistance to oxidation at high temperatures, especially in the vicinity of 900° C.

BACKGROUND OF THE INVENTION

The search for new alloys for aircraft parts satisfactory for severe operating conditions, particularly in engines, must take into account various parameters, including high temperature stability and a minimum mass for a specific level of mechanical characteristics. The use of niobium (Nb) could meet these conditions through a high melting point (2470° C.) and a relatively low density (8.6).

EP-A-0 345 599 discloses a group of alloys of which the atomic percentage composition comprises from 31 to 48% Ti, from 8 to 21% Al, and Nb as the remainder. Some advantageous mechanical properties are exhibited by these known alloys. However, they are not entirely satisfactory because the concentration of aluminum is inadequate to permit the formation of a continuous layer which is sufficiently protective in an oxidizing medium at high temperatures for some of the particular applications, especially in the aeronautical field, which are envisaged by the present invention.

It is, in fact, generally known that niobium based alloys have a low resistance to high temperature oxidation because the $Nb_2O_5$ oxide formed does not constitute a protective layer. One of the oxides which would possess such a property is aluminum oxide $Al_2O_3$.

In addition to layer flaking problems, however, serious obstacles stand in the way of the development of alloys capable of forming a continuous coating of aluminum oxide. On the one hand, a minimum concentration of aluminum is necessary for the formation of the layer and, on the other hand, very high temperatures, above 1200° C., are required for activation of the protective coating forming process. Indeed, the formation of a continuous coating of aluminum oxide appears impossible in the case of a binary Nb-Al alloy because a high aluminum content, although improving the resistance of the binary alloy to oxidation, is detrimental by virtue of the formation of fatigue-producing phases.

The addition of a third element, such as titanium, enables the quantity of brittle phases to be reduced and, at the same time, promotes the formation of a more protective layer of oxides.

For certain uses, the known alloys do not possess an adequate resistance to oxidation in the vicinity of 900° C. The aforementioned EP-A-0 345 599 recommends making protective coatings to improve the resistance to oxidation of parts made from the alloys described. However, these techniques have their own drawbacks, such as increased costs and manufacturing steps, and the need for additional means to implement the process.

SUMMARY OF THE INVENTION

Consequently, it is an object of the present invention to provide a group of niobium and titanium based alloys which do not suffer the drawbacks of the above-mentioned solutions and possess a high resistance to oxidation at high-temperature, particularly in the vicinity of 900° C.

According to the invention, such an alloy has a chemical composition comprising, in atomic percentages:

more than 30% Nb
from 30 to 48% Ti
from 21 to 38% Al and possibly any one or more of Cr, Mo, V and Zr in an amount totalling not more than 8%.

The invention will now be explained in more detail with reference to the attached drawings and the examples included herein.

DETAILED ANALYSIS OF THE INVENTION

In the study of the resistance of alloys to high temperature oxidation a linear oxidation constant $K_L$ and a parabolic constant $K_p$ are defined by the relations:

$$\frac{\Delta M}{S} = A + K_L t$$

and $$\frac{\Delta M}{S} = B + (K_p t)^{\frac{1}{2}}$$

wherein

ΔM is the increase in weight of the specimen due to oxidation,
S is the surface area,
A is a constant
B is a constant, and
t is the time in hours during which the specimen is subjected to the oxidation conditions.

With respect to units, $K_L$ is measured in milligrams per $cm^2$ per hour, and $K_p$ is measured in $g^2\ cm^{-4}\ s^{-1}$.

Depending on the alloy, the oxidation kinetics will be analayzed best by one or other of the two formulae. However, to facilitate comparisons, the two constants are often calculated for the same alloy.

The oxidation behaviour of alloys in accordance with the invention has been studied on materials prepared by arc melting in argon.

It is obvious that a refining of microstructure and better homogeneity will be useful. This may be obtained, for example, by shaping by extrusion or forging, or by using processing techniques associated with prealloyed powder metallurgy.

Figure 1:
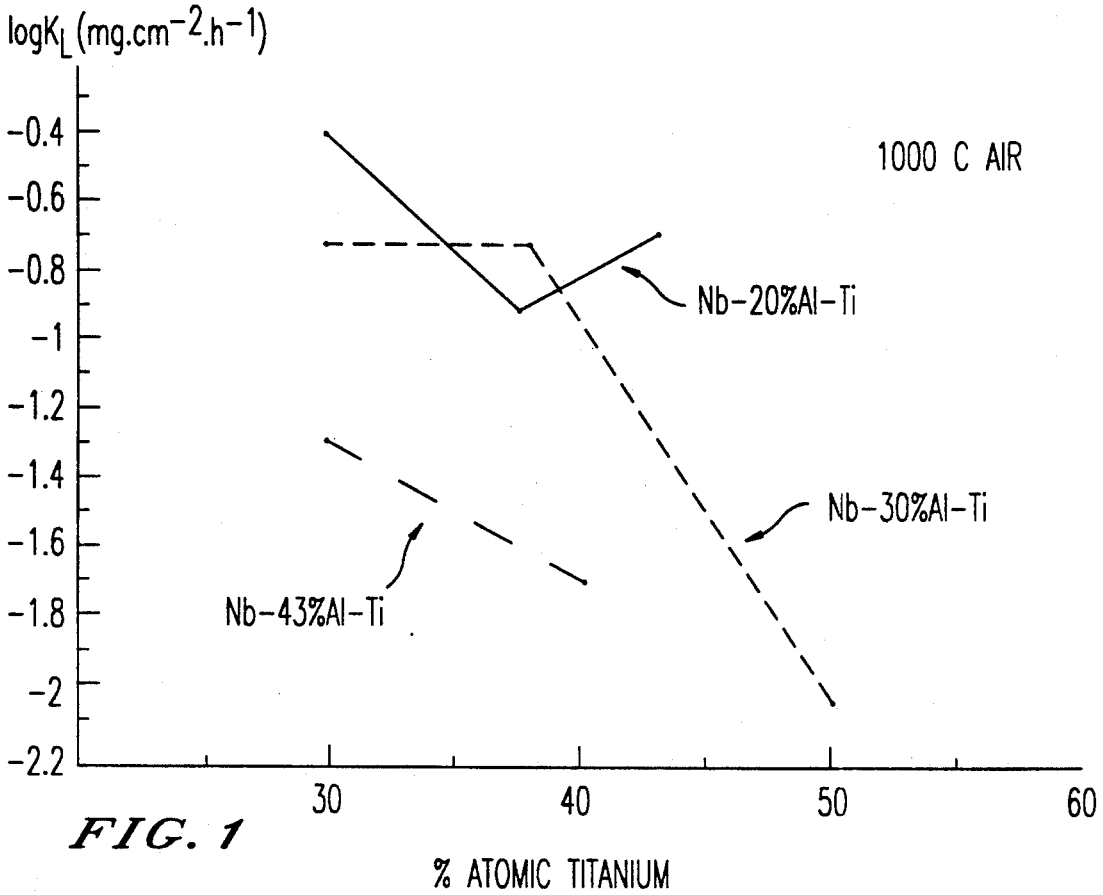
FIGS. 1 and 2 show graphically results obtained for resistance to air oxidation of niobium based alloys containing various proportions of titanium and aluminum.
Figure 2:
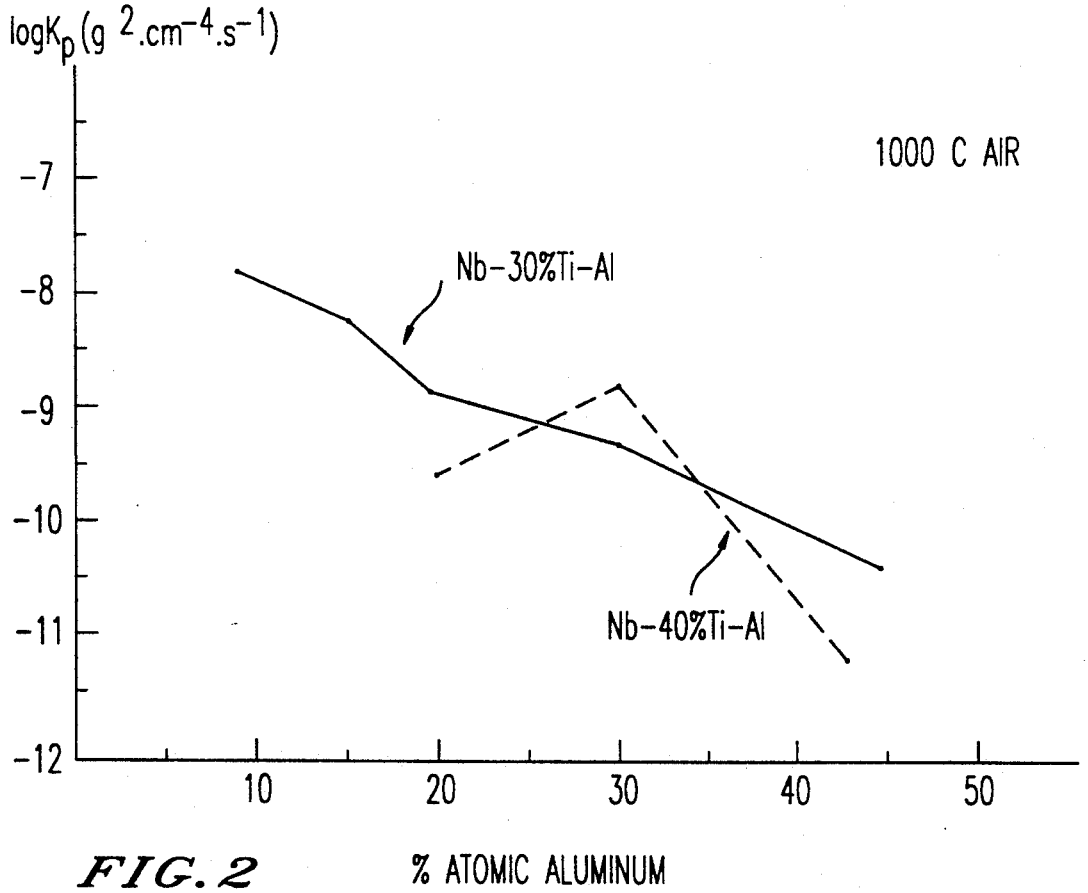

FIGS. 1 and 2 plot the results obtained from various specimens of ternary alloys of Nb-Ti-Al type placed in oxidizing conditions, at 1000° C., in air.

Figure 4:
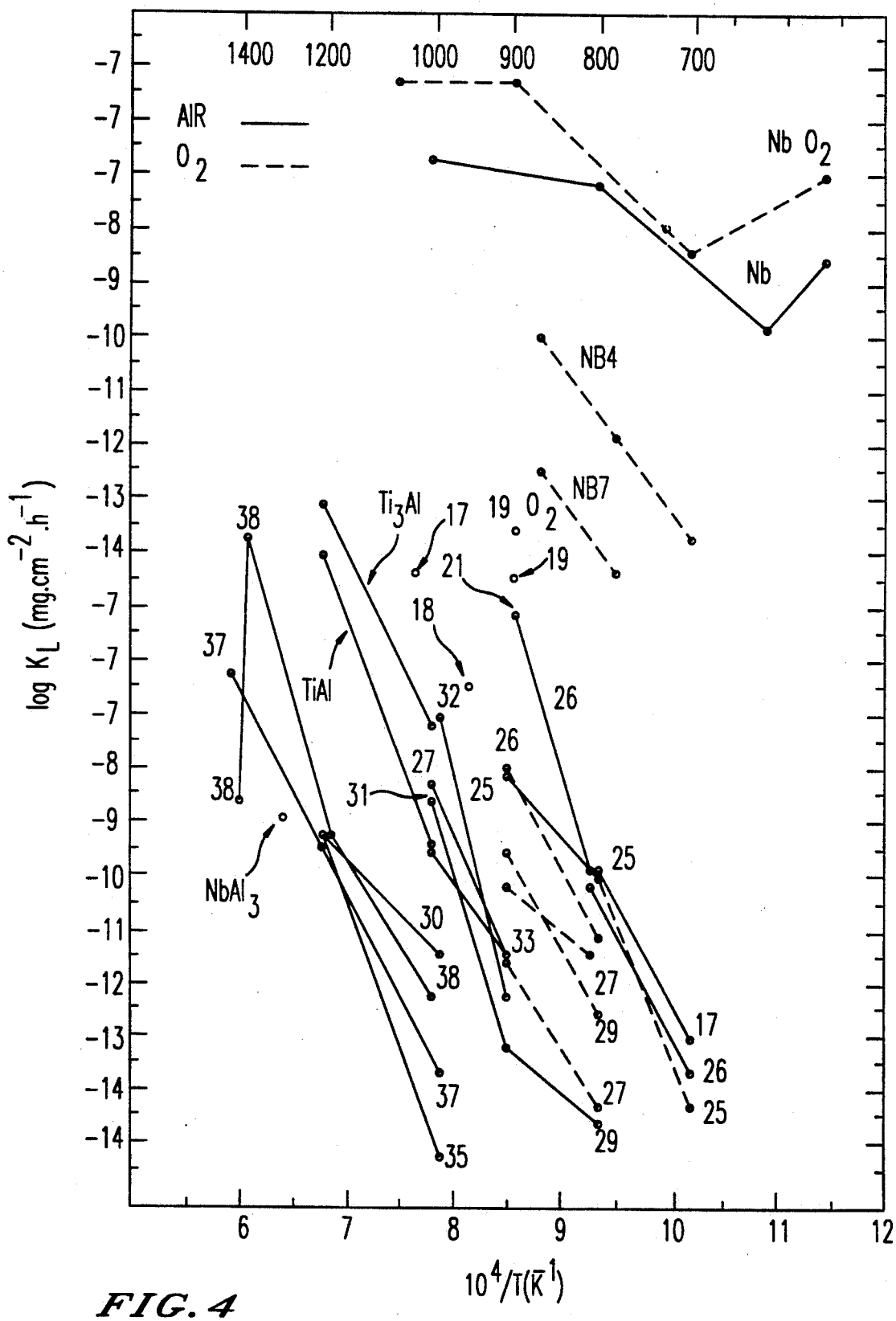
FIG. 4 shows graphically comparative results of linear oxidation kinetics for the alloys having the compositions given in Table 1.

FIG. 4 shows the variations of the linear oxidation constant $K_L$ as a function of temperature and FIG. 5 the variations of the parabolic constant $K_p$, for the alloys having the compositions which are given, in atomic percentages, in Table 1 below.

From these figures the following results can be deduced:

at 900° C. in air, $K_L$ reduces from 0.97 to 0.025 when the atomic content Al increases from 5% to 30% (see alloys 26 and 29 of FIG. 4);

at 1000° C. in air $K_L$ reduces from 1.35 to 0.02 when Al increases from 8% to 43% in Nb-30%Ti (FIG. 4).

at 1000° C. in air $K_L$ reduces from 0.2 to 0.01 when Ti increases from 30% to 50% in Nb-30%Al (FIG. 1).

The addition of titanium increases the solubility of aluminum in the niobium-based alloy, whereas the presence of Cr and V reduces the diffusivity of oxygen, which is especially effective at very high temperatures (in excess of 1000° C.) These combined effects enable a protective layer containing aluminum oxide to be obtained for aluminum contents smaller than in the absence of the said elements. The addition of zirconium may be made in order to trap oxygen during manufacture, and this element has, moreover, a hardening effect. The addition of Mo may improve the mechanical properties of the alloy.

The results noted above and represented in FIGS. 1 and 2 show that the combined effect of the additions of Ti and Al to niobium provide a considerable gain in the high temperature oxidation resistance properties of the alloy. In fact, the oxidation kinetics in the vicinity of 900° C. of an alloy in accordance with the invention is lowered by a factor of at least 1000 relative to that of pure niobium, as can be seen from FIG. 4.

Figure 3:
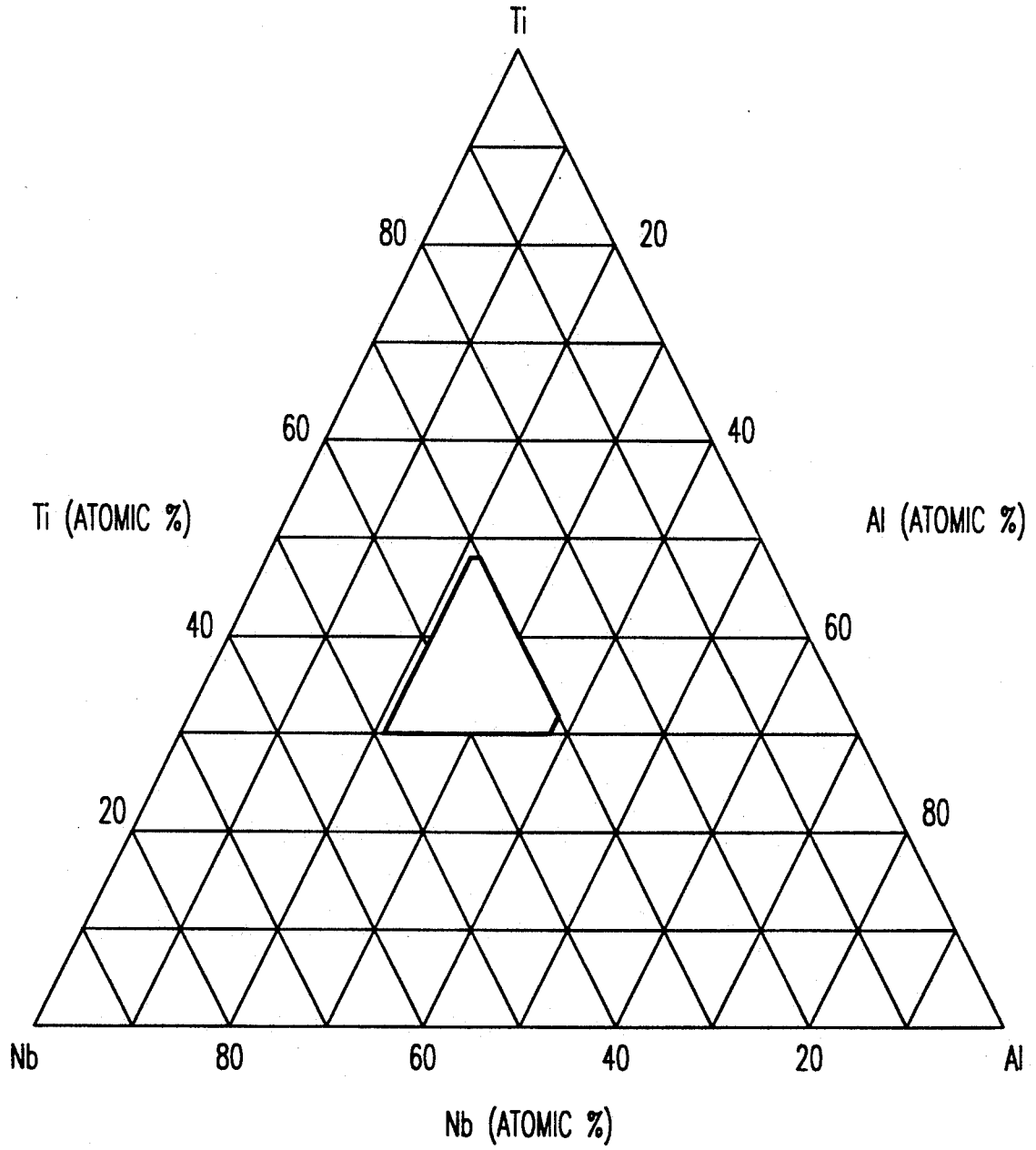
FIG. 3 shows the composition range of the alloys in accordance with the invention on a ternary Nb-Ti-Al projection.

FIG. 3 shows an area A corresponding to the alloy compositions of the invention, according to an Nb, Ti, Al ternary diagram. It will also be noted that the contents involved, particularly of Ti and Al, make it possible to obtain alloys with a density which is below 6.5.

EXAMPLES

Example 1

For the sake of example, alloy No. 29 of Table 1 has been made the subject of more detailed study, the alloy having the following composition, in atomic percentages:

Nb=31%; Ti=38%; Al=30%; Zr=1%

In terms of percentages by weight, this corresponds to:

51.7% Nb; 32.5% Ti; 14.2% Al and 1.6% Zr.

The alloy has a density of 5.38.

Figure 5:
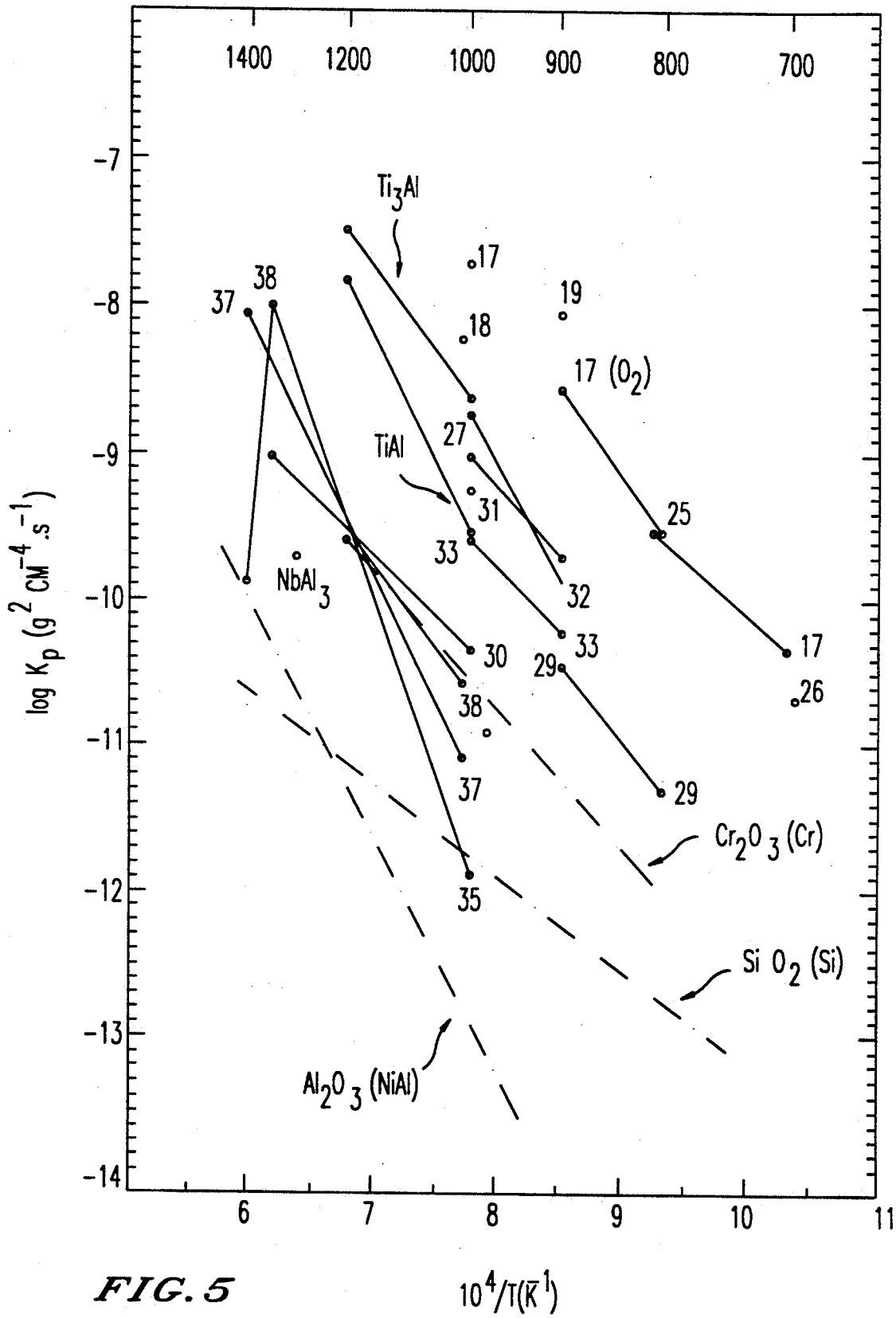
FIG. 5 shows graphically comparative results for variation of the parabolic kinetic constant for the same alloys.

An examination of FIG. 5 shows that this alloy No. 29 has oxidation kinetics at 900° C. little more than that of a nickel-based superalloy.

Similarly, an examination of FIG. 4 shows that alloy No. 29 has a linear constant at 900° C. about 2000 times lower than that of pure niobium.

Example 2

By way of further example., another alloy No. 33 has also been studied in more detail. This alloy has the following composition, by atomic percentages of the elements:

Nb=40%; Ti=38%; Al=21%; Zr=1%

By weight, this corresponds to:

60.5% Nb; 29% Ti; 9% Al; 1.5% Zr, and the alloy has a density of 5.9.

An examination of FIGS. 4 and 5 shows that this alloy, which is slightly less rich in aluminum than alloy No. 29, has slightly faster oxidation kinetics, while nevertheless remaining acceptable.

With regard to the other alloys of the invention, the composition of the protective layer may differ from that of alloy No. 29; however, it still retains advantageous properties of oxygen-tightness.

The alloys in accordance with the invention may be produced by arc melting or by any melting process enabling an ingot of homogeneous composition to be obtained.

Advantageously, pre-alloyed powder metallurgy techniques may be used when employing these alloys.

TABLE 1

| Alloy | Nb | Ti | Al | Cr | V | Zr |
|---|---|---|---|---|---|---|
| 17 | 61 | 30,8 | 8,2 | 0 | 0 | 0 |
| 18 | 55 | 30 | 15 | 0 | 0 | 0 |
| 19 | 75,4 | 10 | 14,6 | 0 | 0 | 0 |
| 25 | 61 | 31,6 | 0 | 0 | 7,4 | 0 |
| 26 | 42 | 52 | 5 | 0 | 0 | 1 |
| 27 | 35,5 | 43,5 | 20 | 0 | 0 | 1 |
| 29 | 31 | 38 | 30 | 0 | 0 | 1 |
| 30 | 24,5 | 30 | 44,5 | 0 | 0 | 1 |
| 31 | 39 | 30 | 30 | 0 | 0 | 1 |
| 32 | 49 | 30 | 20 | 0 | 0 | 1 |
| 33 | 40 | 38 | 21 | 0 | 0 | 1 |
| 35 | 16 | 50 | 33 | 0 | 0 | 1 |
| 37 | 16 | 40 | 43 | 0 | 0 | 1 |
| 38 | 15 | 37 | 40 | 3 | 4 | 1 |

We claim:

1. A niobium and titanium based alloy having a density of less than 6.5 and possessing a high resistance to oxidation at high temperature, particularly in the vicinity of 900°, wherein said alloy has the following chemical composition, in atomic percentages:

at least 35.5% Nb
from 30 to 48% Ti
from 21 to 38% Al and from 1 to 8% Cr, Mo, V, Zr, or a mixture of any two or more thereof.

2. A niobium and titanium based alloy having a density of less than 6.5 and possessing a high resistance to oxidation at high temperature, particularly in the vicinity of 900° C., wherein said alloy has the following chemical composition, in atomic percentages:

more than 30% Nb
from 30 to 48% Ti
from 21 to 38% Al
and from 1% to 8% Zr.

3. An alloy according to claim 2, wherein the chemical composition of said alloy, in atomic percentages, is:

31% Nb, 38% Ti, 30% Al, and 1% Zr.

4. An alloy according to claim 1, wherein the chemical composition of said alloy, in atomic percentages, is:

40% Nb, 38% Ti, 21% Al, and 1% Zr.

5. A niobium and titanium based alloy having a density of less than 6.5 and possessing a high resistance to oxidation at high temperature, particularly in the vicinity of 900° C., wherein said alloy has the following chemical composition, in atomic percentages:

more than 30% Nb
from 30 to 48% Ti
from 21 to 38% Al
and from 1% to 8% of Zr in admixture with at least one of Cr, Mo, and V.

* * * * *

UNITED STATES PATENT AND TRADEMARK OFFICE

CERTIFICATE OF CORRECTION

PATENT NO. : 5,284,618

DATED : FEBRUARY 8, 1994

INVENTOR(S) : Michel L. ALLOUARD et al

It is certified that error appears in the above-identified patent and that said Letters Patent is hereby corrected as shown below:

Column 2, line 46, "A is a constant" should read --A is a constant, --.

Column 3, line 17, "(in excess of 1000°C.)" should read —(in excess of 1000°C.).—

Column 4, line 37, "900°, wherein" should read --900°C, wherein--.

Column 4, line 55, "according to claim 1," should read --according to claim 2,--.

Signed and Sealed this

Thirty-first Day of January, 1995

*Attest:*

Bruce Lehman

BRUCE LEHMAN

*Attesting Officer*

*Commissioner of Patents and Trademarks*